United States Patent [19]

Hillebrenner et al.

[11] Patent Number: 4,736,666

[45] Date of Patent: Apr. 12, 1988

[54] ALIGNMENT RING FOR MOLD-IN-PLACE PROJECTILE

[75] Inventors: Gary L. Hillebrenner, Carbondale; George W. Barton, Marion, both of Ill.

[73] Assignee: Olin Corporation, Stamford, Conn.

[21] Appl. No.: 762,700

[22] Filed: Aug. 5, 1985

[51] Int. Cl.[4] ..... F42B 33/10; C06B 21/00

[52] U.S. Cl. ..... 86/1.1; 29/1.23; 102/520; 102/521; 102/526; 102/527; 102/528

[58] Field of Search ..... 86/1.1, 43; 102/520, 102/519, 521, 523, 526, 524, 527, 528; 29/1.2, 1.21, 1.22, 1.23, 1.3

[56] References Cited

U.S. PATENT DOCUMENTS

| | | | |
|---|---|---|---|
| 3,714,900 | 2/1973 | Feldmann | 102/52 |
| 4,360,954 | 11/1982 | Burns, et al. | 102/521 |
| 4,419,796 | 12/1983 | Broden et al. | 29/1.23 |
| 4,459,894 | 7/1984 | Bunch | 86/1 R |
| 4,558,646 | 12/1985 | Hoffmann et al. | 102/527 |

*Primary Examiner*—Stephen J. Lechert, Jr.
*Assistant Examiner*—Howard J. Locker
*Attorney, Agent, or Firm*—Bruce E. Burdick

[57] ABSTRACT

A method of manufacturing a sabot projectile is disclosed in which the projectile core is used as the core pin of a mold and a sabot is molded directly onto and in alignment with the projectile core and the core nose is held by a special alignment ring.

8 Claims, 1 Drawing Sheet

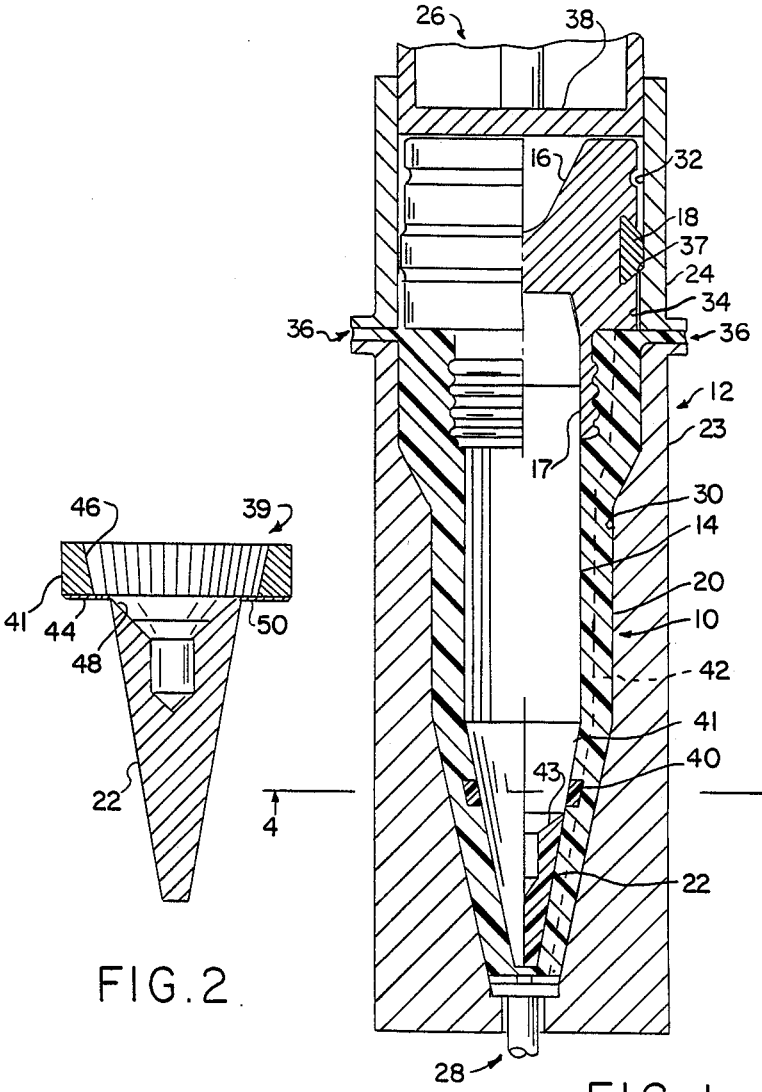
FIG. 1
FIG. 2
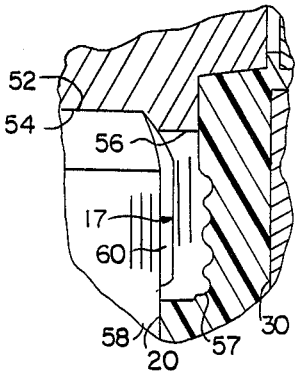
FIG. 3
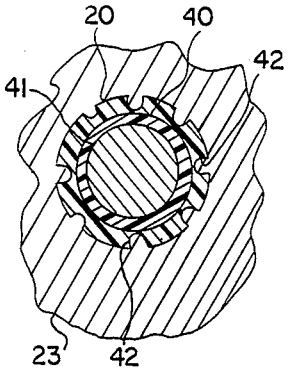
FIG. 4

ALIGNMENT RING FOR MOLD-IN-PLACE PROJECTILE

This invention relates to ammunition projectiles with sabots and specifically to a process for making such projectiles. This invention was developed at private expense, not with government funds.

BACKGROUND OF SUMMARY OF THE INVENTION

The invention is an improvement upon the invention described in prior U.S. Pat. No. 4,459,894, the disclosure of which is incorporated by reference herein as if set forth at length. The Phalanx gun is the gun currently used by the Navy to shoot down incoming cruise missiles by tracking the missile and accurately firing a barrage of high velocity armor-penetrating projectiles at the missile until it is destroyed. Inaccuracy of the gun or ammunition could conceivably lead to the projectiles missing the missile with resultant loss of an aircraft carrier or other extremely vital naval vessel together with its crew. The conventional Phalanx ammunition round includes a sophisticated projectile. The projectile has a depleted uranium core ("penetrator") designated to penetrate metallic armour within a surrounding light plastic "sabot" designed to seal the depleted uranium from the environment until the projectile is launched and allow the penetrator to be fired from a large diameter barrel bore so as to have the propelling pressure act over a bigger area and thus produce a bigger force on the penetrator which in turn gives greater acceleration and ultimately higher velocities to the penetrator. The projectile also has a pusher plug designed to impart spin to the penetrator to enhance penetration and designed to protect the penetrator from contact by the hot propellant gases during firing. In order to minimize cost and parisitic weight, this pusher plug is conventionally aluminum and has a ringshaped rotating band around it to protect the gun barrel from aluminum fouling which might otherwise occur if the aluminum pusher plug were to directly contact the barrel bore. In order to be most effective, it is necessary that the rotating band, penetrator (projectile core), pusher plug and sabot all be aligned with each other, and especially the rotating band and projectile core. If the core and band are misaligned even slightly, the spin-up of the projectile about the axis of the rotating band will result in wobbling of the core and resultant inaccuracy. The present invention has effectively minimized "balloting" (wobble in the barrel) and "coning" (wobbling in flight) due to the misalignment above noted and has done so at reduced cost, thus allowing for more rounds of better ammunition to be acquired within the same defense budget. The present invention further improves upon the method of U.S. Pat. No. 4,459,894 by doing this in a manner which is practical for high volume production.

The invention achieves this end by providing a manufacturing method in which the core, sabot, plug and band are all simply, effectively and automatically aligned with each other so that misalignment is effectively eliminated. The invention also allows for an unstressed sabot in contrast to the conventional sabot which is highly stressed when assembled. High sabot stresses before loading and firing are advantageouly avoided by the invention thus eliminating conventional misalignments caused by uneven stress-strain properties within the sabot. A special alignment ring insures alignment of the penetrator with the rotating band and sabot mold during molding of the sabot.

BRIEF DESCRIPTION OF DRAWINGS

The invention will be better understood by reference to the attached drawing in which FIG. 1 is a diametrical cross-sectional view taken along the longitudinal axis of a projectile 10 just after molding within a mold 12, FIG. 2 is an enlarged diametrical cross-sectional view taken along the axis of penetrator alignment ring/windscreen.

FIG. 3 is an enlarged cut-away view of a portion of the projectile and mold to show a pusher plug alignment lip; and FIG. 4 is a cross-sectional view taken along lines 4—4 of FIG. 1.

DETAILED DESCRIPTION

Referring to FIG. 1, projectile 10 comprises a projectile core ("penetrator") 14, a pusher plug 16, a rotating band 18 about the plug 16, a discarding sabot 20, surround core 14, an alignment ring 40 and a projectile nose cover 22, the purposes of which have been described above except nose cover 22 and ring 40. Nose cover 22 is aluminum, plastic or other protective material designed to protect the nose of the projectile from abrasion or supersonic heating during flight, especially where the penetrator 14 is made of an incendiary material like depleted uranium. Alternatively cover 22 may be an incendiary material to aid the "burning" action necessary to penetrator armour. Projectile 10 can have any desired external shape such as the exemplary modified Phalanx shape shown. Alignment ring 40 can also be made of plastic, aluminum and serves to help align penetrator 14 in a mold 12 in which the sabot is molded. Alignment ring 40 is preferably molded as an integral plastic piece together with nose cover 22 to minimize parts during assembly.

The sabot 20 of projectile 10 abuts against pusher 16, whereas in conventional Phalanx ammunition there is a gap between the rear (top as shown) of the sabot 20 and the front (bottom as shown) of the plug 16, the size of the gap being a function of the amount of pre-stress on the conventional Phalanx sabot. The invention is applicable to other saboted rounds than the modified Phalanx projectile shown.

Mold 12 comprises a main mold body 23, an upper alignment mold body 24, a holder 26 and an ejector 28. Main body 23 has a tapered circular interior cavity wall 30 which has the desired exterior sabot shape. Upper alignment body 24 is a hollow cylindrical body with upper and lower inside walls 32, 34 separated by an upwardly facing interior annular abutment shoulder 37 which is carefully coaxially aligned with the axis of the cavity 30 of main body 22 when bodies 23 and 24 are joined. Wall 32 is of just slightly larger diameter than the outside diameter of band 18 while wall 34 is of a smaller diameter just slightly larger than the outside diameter of the sidewall of pusher plug 16 in front of band 18. Shoulder 37 is downwardly tapered in conformance with the front edge of band 18. The fit between wall 34 and plug 16 and between band 18 and shoulder 37 is preferably tight enough that a minimum amount of molding medium enters the space there between. Bodies 23 and 24 cooperate to define mold openings 36 (preferably four openings spaced 90° apart) therebetween. Bodies 23 and 24 can be a single integral piece of desired. Conventional flow control means and plastic supply, timing, heating means (not shown) would be used to control plastic flow through mold 12. Holder 26 is a simple push cup 38 or other pressure plate means for holding band 18 against shoulder 37 during molding. This holding action, together with the fixed alignment between shoulder 37 and cavity wall 30 results in an aligned band, plug and sabot. Alignment between core 14 and the other components (especially band 18) is initially achieved by pre-aligned fit between plug 16 and core 14, which is accomplished by a rear alignment lip 58 (see FIG. 3), and later by a front alignment ring 40 which rests against slotting projections 42 of mold cavity wall 30. Plug 16, core 14 and nose piece 39 (see FIG. 2) can be preassembled as a unit and alignment checked easily before insertion into the mold since the core 14 is not yet hidden by the sabot 20 at that stage of the process.

With the aligned core, plug and band held in place by contact of band 18 with shoulder 37 of the mold wall and the pusher plug 16, by contact of lip 58 with the plug 16 and core 14, and by contact of ring 40 with the core 14 and the slotted projections 42 of cavity wall, the molding is accomplished to produce an aligned, unstressed sabot. At this stage is will be appreciated that an accurate, uniform and reliable alignment of all projectile components is achieved. Since the sabot is molded right on the core, the sabot is unstressed and this alignment is thereafter not likely to change and the sabot is not likely to crack prematurely due to later minor stressing. After the molded sabot cures, the holder 26 is released and ejector 28 is raised to shove the completed projectile up out of the mold.

The alignment method of the invention is highlighted in FIGS. 2, and 3 and 4. FIG. 2 shows an integral nose piece 39 which comprises nose cover (or "windscreen") 22, an alignment ring 40 and a frangible connector 44. Connector 44 is designed to break at point 50 and slide down ogive 41 upon insertion of the pre-assembled penetrator, plug and nose piece into the sabot mold 23 when ring 40 hits the inner surface of slotting projections 42 while the nose cover continues forward with penetrator 14 due to the front 43 of penetrator 14 pushing on the rear 48 of nose cover 22. Ring 40 has a forwardly tapered inner surface 46 to allow this.

FIG. 3 shows the alignment lip 58 which projects radially inward from a front cavity wall 17 of pusher plug 16. Wall 17 has slots 56 which allow easier insertion of core 14 into plug 16 and to allow plastic to enter and fill any space between wall 17 and core 14 to thus help maintain their alignment. Lip 58 has a right cylindrical inner surface to help assure correct alignment of core 14 and plug 16. Slots 56 divide the front (bottom as shown) of plug 16 into fingers 57 which can expand slightly to allow for manufacturing variations within tolerances.

During molding (as best shown in FIG. 4), the molten sabot material can flow around the ring 40 to entirely seal over the nose cover 22 so as to avoid the unsealed or easily crushed nose configuration of prior art methods such as Broden et al U.S. Pat. No. 4,419,796 which hold the base of the penetrator with a jig during molding. Ring 40 then becomes an integral part of sabot 14, but only has the thickness of the weakened, slotted portions of the sabot so that sabot breakup is not affected. In addition, if the nose piece and sabot plastic are of different colors (e.g. black nose piece and orange sabot) then the presence of the alignment ring (and hence an aligned sabot) can be visually verified in the finished projectile despite the presence of the sabot by simply looking for black in the sabot slots.

ADVANTAGES OF THE INVENTION

Concentricity (alignment) is assured. The sabot is not a separate component so inspection load is lightened. The sabot is not in a highly prestressed material state as it is when it is assembled conventionally either in "drill and pin" or welded configurations, thus reducing the likelihood of in-field cracking problems. The external configuration has no gap between sabot and pusher plug to collect debris which might later damage a barrel. The molding-in-place process of the invention produces intimate contact between the sabot and the pusher plug to increase joint strength thereby increasing resistance to torque, bending and tensile forces. Also a hermetic seal is provided about the projectile to prevent contamination from or to the projectile core (penetrator). Consistency of sabot separation is improved since the stress levels are uniform and low (resulting only from material shrinkage during mold curing). Regrind plastic (surplus) can be used.

In short, a much better projectile at much less cost is available as a result of the invention.

In view of the substantial benefit to the public to be produced by this invention and in view of its surprising superiority, this invention is to be understood as being quite broadly entitled to a wide range of equivalents within the scope of the overall methods claimed below.

What is claimed is:

1. A process for manufacturing a sabot projectile which comprises the steps of:

A. inserting a projectile core into a pusher plug in aligment with said plug;

B. placing an expandable alignment ring about the periphery of a frontal portion of the projectile core;

C. inserting the aligned core and plug axially into a mold in rough axial alignment with the mold so that the alignment ring contacts an inner surface of the mold and is axially restrained by the inner surface while the projectile core continues to move forward through the alignment ring until fully inserted into the mold, the alignment ring expanding during such continued movement and guiding the core into a final precise alignment with the mold;

D. molding a unitary sabot about said core while said core is held in the final precise alignment by the pusher plug and alignment ring;

E. holding said core and plug in said inserted aligned position during said molding; and F. removing said core-plug-molded sabot combination from said mold.

2. The method of claim 1 wherein said alignment ring is integral with a nose cover at the time of placing the alignment ring on the core and the continued movement of the core through the alignment ring during insertion of the core into the mold separates the alignment ring from the nose cover so that the nose cover can continue separately further into the mold than said alignment ring during insertion.

3. The method of claim 2:

a. wherein the mold cavity has a plurality of slotting projections projecting radially inward from and extending axially along an inner wall of the mold cavity adjacent the ogive of the inserted core and forming the inner surface by which the alignment ring is axially restrained, and b. wherein the molding of the sabot includes causing plastic material to flow between the slotting projections and around the alignment ring so that the ring becomes an integral part of the sabot.

4. The method of claim 3 wherein the final precise alignment is further assured by a precisely aligned inward shoulder on the inner surface of the mold cavity which contacts and thus limits the extent of travel into the mold of a rotating band on the pusher plug.

5. The method of claim 2 wherein the final precise alignment is further assured by a precisely aligned inward shoulder on the inner surface of the mold cavity which contacts and thus limits the extent of travel into the mold of a rotating band on the pusher plug.

6. The method of claim 1 wherein the final precise alignment is further assured by a precisely aligned inward shoulder on the inner surface of the mold cavity which contacts and thus limits the extent of travel into the mold of a rotating band on the pusher plug.

7. The method of claim 6:

a. wherein the mold cavity has a plurality of slotting projections projecting radially inward from and extending axially along an inner wall of the mold cavity adjacent the ogive of the inserted core and forming the inner surface by which the alignment ring is axially restrained, and b. wherein the molding of the sabot includes causing plastic material to flow between the slotting projections and around the alignment ring so that the ring becomes an integral part of the sabot.

8. The method of claim 1:

a. wherein the mold cavity has a plurality of slotting projections projecting radially inward from and extending axially along an inner wall of the mold cavity adjacent the ogive of the inserted core and forming the inner surface by which the alignment ring is axially restrained, and b. wherein the molding of the sabot includes causing plastic material to flow between the slotting projections and around the alignment ring so that the ring becomes an integral part of the sabot.

* * * * *